US009462853B2

(12) United States Patent
Hamada et al.

(10) Patent No.: US 9,462,853 B2
(45) Date of Patent: Oct. 11, 2016

(54) SLIDER FOR SLIDE FASTENER

(75) Inventors: Yoshikazu Hamada, Toyama (JP); Keiichi Keyaki, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/114,141

(22) PCT Filed: Apr. 27, 2011

(86) PCT No.: PCT/JP2011/060279

§ 371 (c)(1),
(2), (4) Date: Oct. 25, 2013

(87) PCT Pub. No.: WO2012/147181

PCT Pub. Date: Nov. 1, 2012

(65) Prior Publication Data

US 2014/0041163 A1 Feb. 13, 2014

(51) Int. Cl.
*A44B 19/30* (2006.01)

(52) U.S. Cl.
CPC ..... *A44B 19/30* (2013.01); *A44B 19/308* (2013.01); *Y10T 24/257* (2015.01); *Y10T 24/2566* (2015.01); *Y10T 24/2577* (2015.01)

(58) Field of Classification Search
CPC .. A44B 19/30; A44B 19/301; A44B 19/303; A44B 19/306; A44B 19/305; A44B 19/308; Y10T 24/2577; Y10T 24/2586; Y10T 24/2566; Y10T 24/2571; Y10T 24/257
See application file for complete search history.

(56) References Cited

U.S. PATENT DOCUMENTS 5,625,928 A * 5/1997 Terada et al. ..... 24/424
6,009,602 A 1/2000 Terada
7,870,650 B2 * 1/2011 Keyaki ..... A44B 19/26 24/421
2002/0050031 A1 5/2002 Takasawa et al.
2004/0231114 A1 11/2004 Iwase et al.
2008/0092347 A1 4/2008 Ogura
2008/0148534 A1 6/2008 Iwase et al.

(Continued)

FOREIGN PATENT DOCUMENTS

JP 11-178615 A 7/1999
JP 2002-136309 A 5/2002

(Continued)

OTHER PUBLICATIONS

International Search Report, PCT Application No. PCT/JP2011/060279, mailed Jun. 14, 2011.
Written Opinion, PCT Application No. PCT/JP2011/060279, mailed Jun. 14, 2011.
English Translation of the Written Opinion of the International Searching Authority, PCT Application No. PCT/JP2011/060279, mailed Jun. 14, 2011.

*Primary Examiner* — Robert J Sandy
*Assistant Examiner* — Michael Lee
(74) *Attorney, Agent, or Firm* — Kilpatrick Townsend & Stockton LLP

(57) ABSTRACT

There is provided a slider for a slide fastener. A lock member is swingably supported by a pillar portion which is erected on an upper surface of a body. A cover member covers the pillar portion and the lock member from above. The lock member includes a body portion which is disposed on the upper surface of the body and a claw portion which protrudes from the body portion and enters an element guide path of the body. One side surface of the claw portion is formed with an inclined surface which causes the claw portion to be gradually tapered toward a front end of the claw portion. The other side surface of the claw portion is formed with a stepped portion which causes a plate thickness of the claw portion to be smaller than a plate thickness of the body portion.

4 Claims, 12 Drawing Sheets

(56) References Cited

U.S. PATENT DOCUMENTS

| | | | | |
|---|---|---|---|---|
| 2008/0222854 | A1 | 9/2008 | Keyaki et al. | |
| 2009/0106952 | A1* | 4/2009 | Lin | 24/418 |
| 2012/0204384 | A1* | 8/2012 | Miyazaki et al. | 24/420 |
| 2013/0185904 | A1* | 7/2013 | Ozawa | 24/418 |

FOREIGN PATENT DOCUMENTS

| | | | |
|---|---|---|---|
| JP | 2004-344313 | A | 12/2004 |
| JP | 2008-99975 | A | 5/2008 |
| JP | 2008-0228808 | A | 10/2008 |

* cited by examiner

SLIDER FOR SLIDE FASTENER

This application is a national stage application of PCT/JP2011/060279 which is incorporated herein by reference.

TECHNICAL FIELD

The present invention relates to a slider for a slide fastener, and more particularly, to a slider for a slide fastener with an automatic stop function.

BACKGROUND ART

In the related art, a slider for a slide faster includes a body, a lock member which is swingably supported by the body, a cover member attached to the body in a cantilever manner, with a front end portion thereof being fixed to the upper surface of the body, an opening/closing member which is slidably provided in the body so as to open/close a gap formed between a rear end portion of the cover member and an upper blade of the body, and a coil spring which urges the opening/closing member toward a position where the gap is closed, and a pull-tab is detachably maintained between the body and the cover member (e.g. refer to Patent Document 1).

PRIOR ART DOCUMENT

Patent Document

Patent Document 1: Japanese Patent Application Publication No. 2008-228808A

SUMMARY OF INVENTION

Problems to be Solved by Invention

As a slide fastener for opening and closing right and left front body portions, a slide fastener with a separable end stop having a box pin and insert pin at the end portions of fastener element rows is used. In a case where the slider for slide fastener disclosed in Patent Document 1 is attached to the slide fastener with the separable end stop, in order to improve the operability for closing the separable end stop, the insert pin may be provided with an inclined surface on the front end portion thereof such that a claw portion of the lock member is pushed up when the insert pin of the separable end stop is inserted into the slider. However, if the insert pin is provided with the inclined surface, the thickness of the insert pin is reduced, there is the possibility that the strength of the insert pin may vary.

In addition, in the slider for slide fastener disclosed in Patent Document 1, when the claw portion of the lock member is engaged with fastener elements, it is required to insert the claw portion between a gap between the right and left fastener element rows to be engaged. However, it is difficult to insert the claw portion since this gap is narrow. In addition, when engaging the right and left fastener elements in the process of finishing the slide fastener, there is required a lock-releasing device which pushes up the lock member so that a fastener element which does not engage with the claw portion of the lock member does not contact the claw portion of the lock member. This consequently increases the manufacturing cost of the slide fastener.

Accordingly, the present invention has been made keeping in mind the above problems, and an object of the present invention is to provide a slider for a slide fastener in which a claw portion of a lock member can be pushed up when inserting an insert pin into the slider without providing an inclined surface in the insert pin and right and left fastener elements can be engaged with each other without providing a lock-releasing device.

Means for Solving Problems

The object of the present invention is achieved by the following configurations.

(1) A slider for a slide fastener including: a body; a lock member which is swingably supported by a pillar portion which is erected on an upper surface of the body; and a cover member which covers the pillar portion and the lock member from above, wherein the lock member comprises a body portion which is disposed on the upper surface of the body and a claw portion which protrudes from the body portion and enters an element guide path of the body, wherein one side surface of the claw portion is formed with an inclined surface which causes the claw portion to be gradually tapered toward a front end of the claw portion, and wherein the other side surface of the claw portion is formed with a stepped portion which causes a plate thickness of the claw portion to be smaller than a plate thickness of the body portion.

(2) The slider for a slide fastener according to (1), wherein a formation area of the stepped portion is greater than a formation area of the inclined surface in a protruding direction of the claw portion.

(3) The slider for a slide fastener according to (1) or (2), wherein the inclined surface comes into contact with an insert pin of a separable end stop of the slide fastener, so that the claw portion is pushed up.

(4) A slider for a slide fastener including: a body; a lock member which is swingably supported by a pillar portion which is erected on an upper surface of the body; and a cover member which covers the pillar portion and the lock member from above, wherein the lock member comprises a claw portion which enters an element guide path of the body, and wherein one side surface of the claw portion is formed with an inclined surface which comes into contact with an insert pin of a separable end stop of the slider fastener so that the claw portion is pushed up.

Advantageous Effects of Invention

According to the slider for a slide fastener according to the present invention, since the one side surface of the claw portion is formed with the inclined surface which causes the claw portion to be gradually tapered toward the front end of the claw portion, when inserting the insert pin of the separable end stop into the slider, the insert pin comes into contact with the inclined surface so as to push up the claw portion. Thus, it is possible to improve the operability for closing the separable end stop.

In addition, since the other side surface of the claw portion is formed with the stepped portion which causes the plate thickness of the claw portion to be smaller than the plate thickness of the body portion, it is possible to prevent the claw portion from contacting the fastener elements of the slide fastener, which do not engage with the claw portion. Consequently, it is possible to engage the right and left fastener elements with each other without providing the lock-releasing device, thereby reducing the manufacturing cost of the slide fastener.

EMBODIMENTS OF INVENTION

Hereinafter, embodiments of a slider for a slide fastener according to the present invention will be described in detail with reference to the accompanying drawings. In the following description, an upper side refers to an upper side with respect to the paper surface of FIG. 2, a lower side refers to a lower side with respect to the paper surface of FIG. 2, a front side refers to a left side with respect to the paper surface of FIG. 2, a rear side refers to a right side with respect to the paper surface of FIG. 2, a right side refers to a far side with respect to the paper surface of FIG. 2, and a left side refers to a near side with respect to the paper surface of FIG. 2. In addition, the right and left direction of the slider is also referred to as a width direction.

First Embodiment

First, a first embodiment of the slider for a slide fastener according to the present invention will be described with reference to FIG. 1 to FIG. 13.

Figure 1:
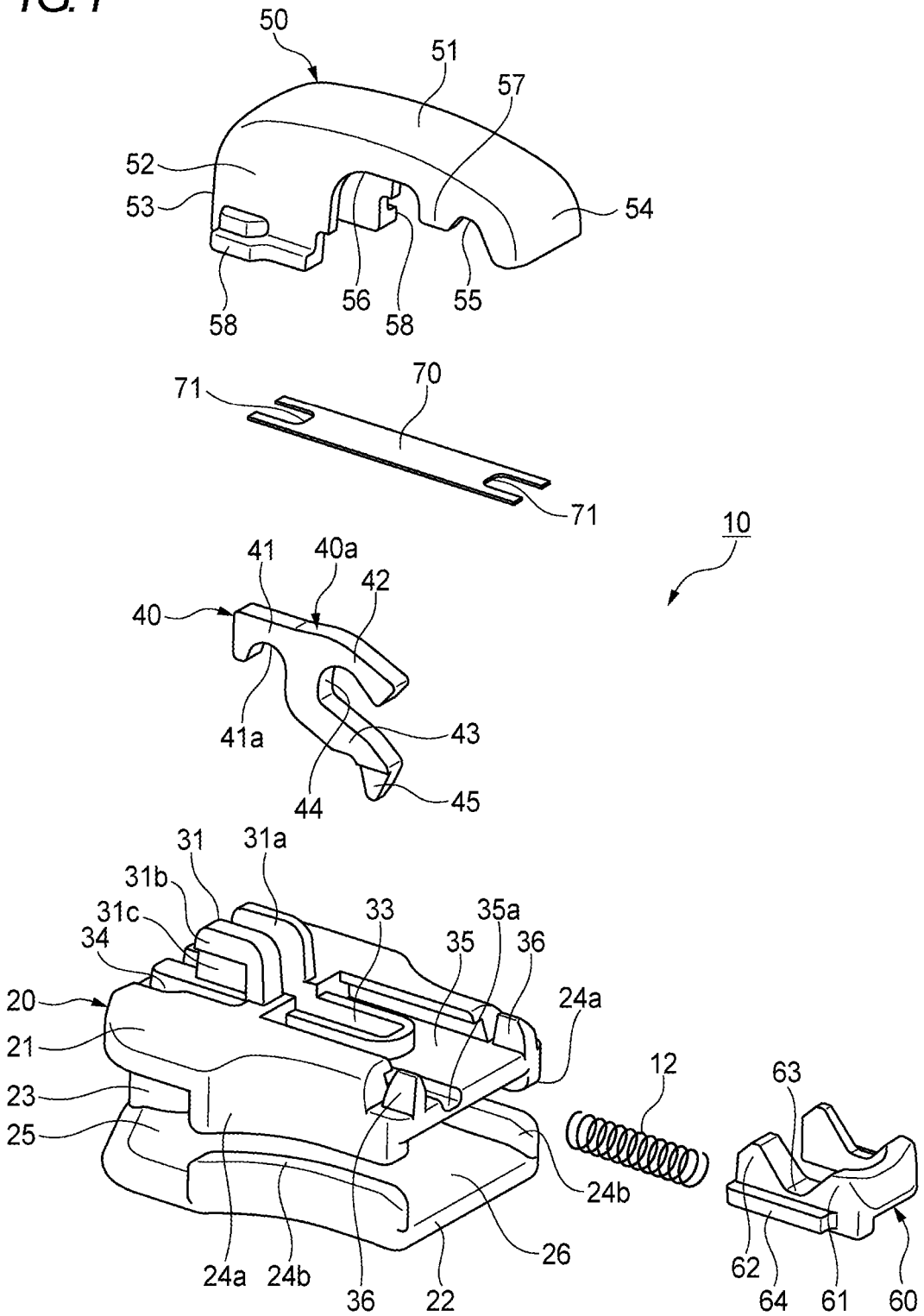
FIG. 1 is an exploded perspective view illustrating a first embodiment of a slider for a slide fastener according to the present invention.
Figure 2:
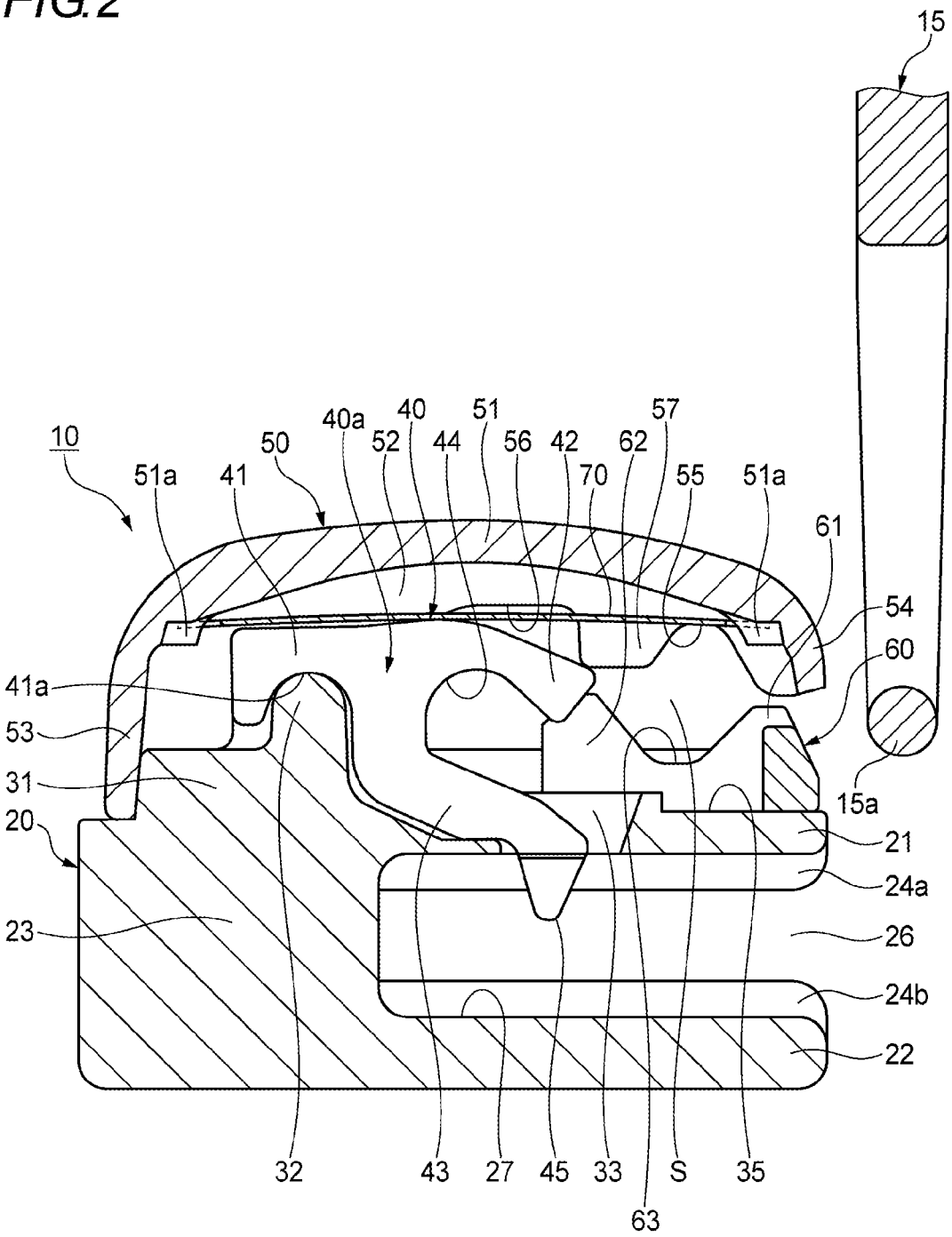
FIG. 2 is a vertical cross-sectional view of the slider for a slide fastener shown in FIG. 1 in a state in which a pull-tab is not mounted.
Figure 13:
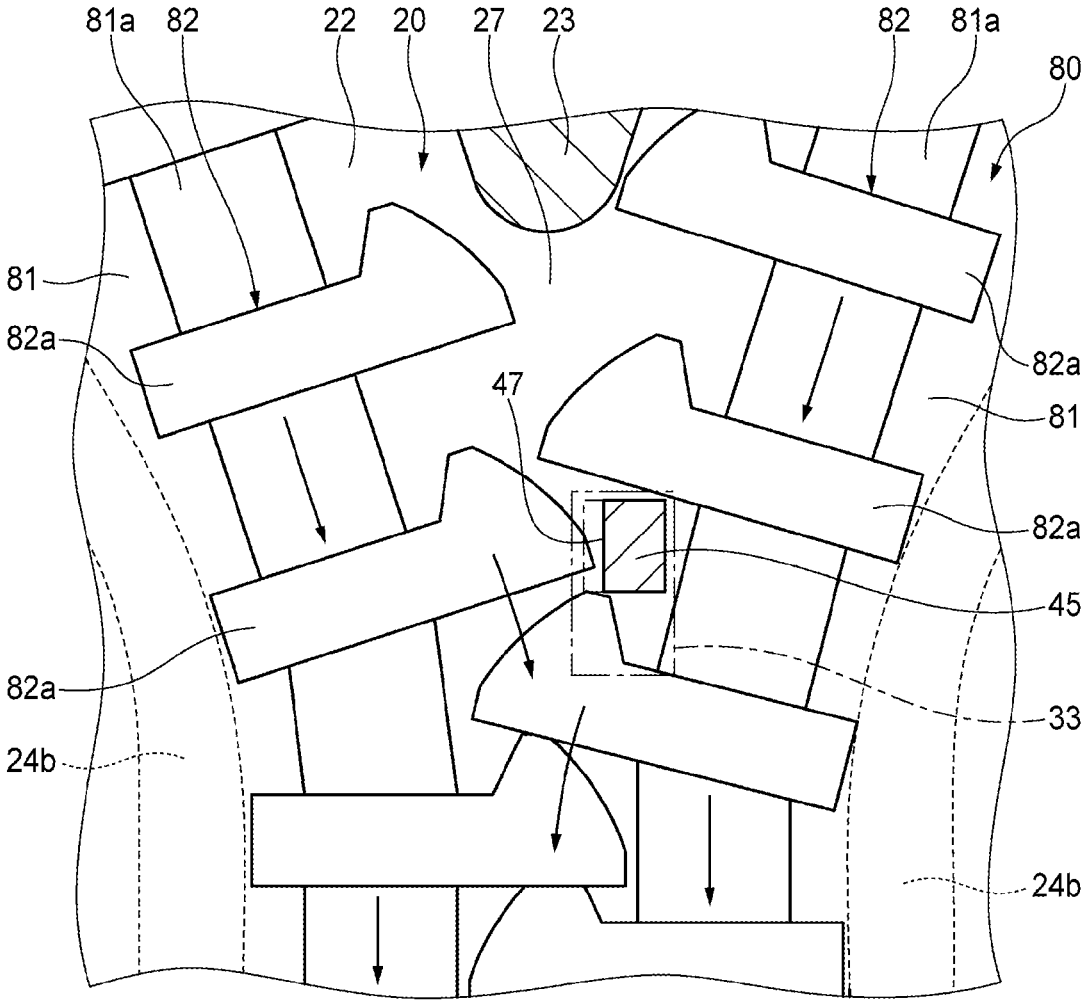
FIG. 13 is an enlarged top-plan view of a main part illustrating a state in which a pair of right and left fastener tapes is moved and right and left fastener elements are engaged with each other.

The slider 10 for a slide fastener according to this embodiment is a slider with an automatic stop function in which a pull-tab can be attached to and detached from a body. As shown in FIG. 1 and FIG. 2, the slider 10 has a body 20 which includes an upper blade 21 and a lower blade 22 which are spaced apart from each other in the upward and downward direction so as to be disposed in parallel to each other, a guide post 23 which connects the front end portion of the upper blade 21 to the front end portion of the lower blade 22, upper flanges 24*a* which protrude downward along right and left side edges of the upper blade 21, and lower flanges 24*b* which protrude upward along right and left side edges of the lower blade 22. Due to this configuration, right and left shoulder mouths 25 which are separated by the guide post 23 are formed in the front portion of the body 20, and a rear mouth 26 is formed in the rear portion of the body 20. In addition, an element guide path 27 which is formed into a substantially Y-shape is formed between the upper blade 21 and the lower blade 22 to communicate the right and left shoulder mouths 25 with the rear mouth 26. The element guide path 27 constitutes a path into which a pair of right and left fastener element rows 82 shown in FIG. 13 is inserted.

In addition, the slider 10 for a slide fastener includes a lock member 40, a cover member 50 and an opening/closing member 60. The lock member 40 is supported by a pillar portion 31 so as to be swingable up and down, the pillar portion 31 being erected on the front end portion of the upper surface of the upper blade 21. The cover member 50 is attached to the upper blade 21 in a cantilever manner, with a front end portion thereof being fixed to the front end portion of the upper surface of the upper blade 21. The cover member 50 covers the pillar portion 31 and the lock member 40 from above. The opening/closing member 60 is formed between the rear end portion of the cover member 50 and the upper blade 21, and is configured to open/close a gap S (hereinafter referred to as "insert gap S") into which a shaft portion 15*a* of the pull-tab 15 is inserted.

The pillar portion 31 has right and left wall portions 31*a*, 31*b* which are spaced apart from each other at a gap into which the lock member 40 can be fitted, and a support convex portion 32 which is formed between the right and left wall portions 31*a*, 31*b*.

Figure 3:
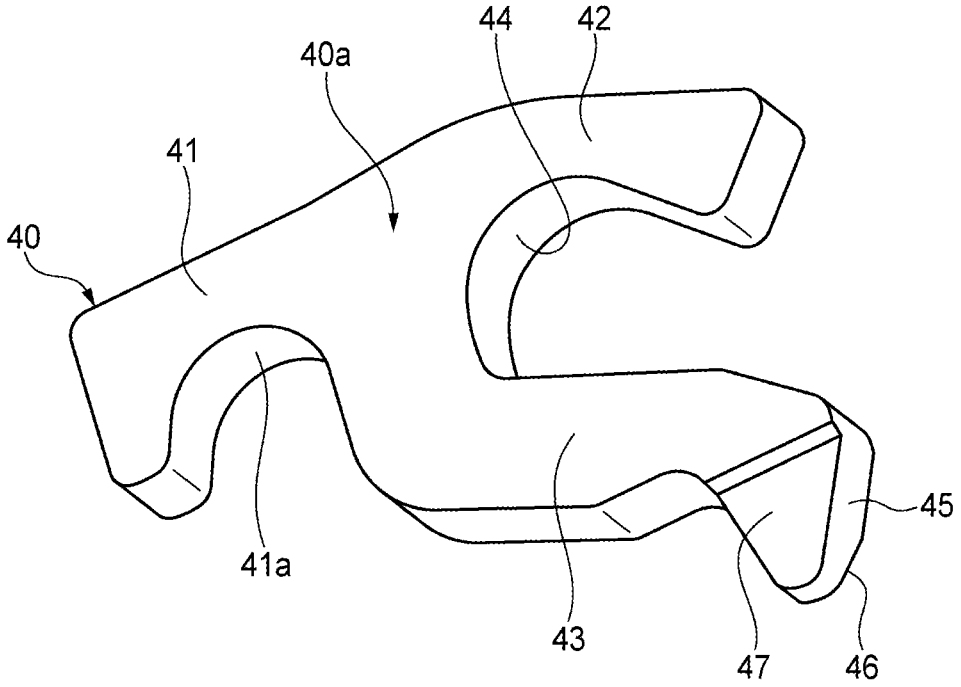
FIG. 3 is a perspective view of the lock member shown in FIG. 1, viewed from the left side.
Figure 4:
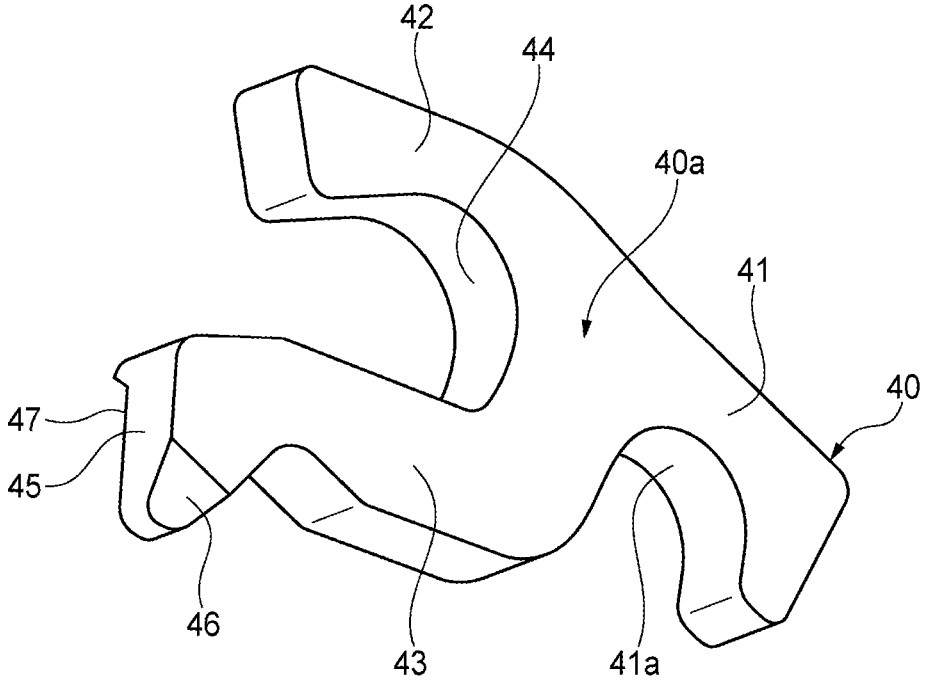
FIG. 4 is a perspective view of the lock member shown in FIG. 1, viewed from the right side.

As shown in FIG. 2 to FIG. 4, the lock member 40 has a body portion 40*a* which is disposed on the upper surface of the upper blade 21. The body portion 40*a* has a base portion 41 which is supported by the pillar portion 31 of the body 20, and an upper piece portion 42 and a lower piece portion 43 which respectively extend rearward from the base portion 41 and are disposed so as to face each other in the upward and downward direction. In addition, an operation recess portion 44 is formed between the upper piece portion 42 and the lower piece portion 43. The operation recess portion 44 is opened toward the rear mouth 26 to accommodate the shaft portion 15*a* of the pull-tab 15 in an attachment state. In addition, a claw portion 45 which is directed downward is provided at the front end portion of the lower piece portion 43. The claw portion 45 is configured to enter the element guide path 27 through a claw hole 33 formed in the upper blade 21. A support concave portion 41*a* which is swingably supported by the support convex portion 32 of the pillar portion 31 is formed in the lower surface of the base portion. The claw hole 33 penetrates from the upper surface of the upper blade 21 to the element guide path 27.

Figure 5:
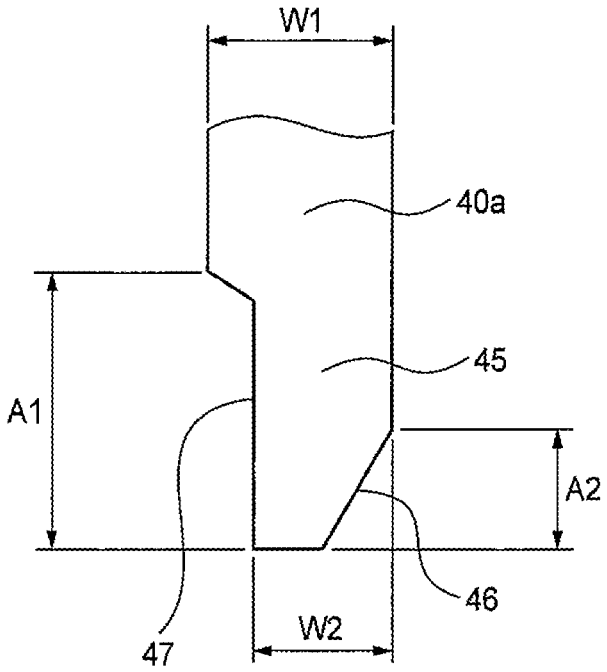
FIG. 5 is an enlarged rear view of the claw portion shown in FIG. 1.
Figure 11:
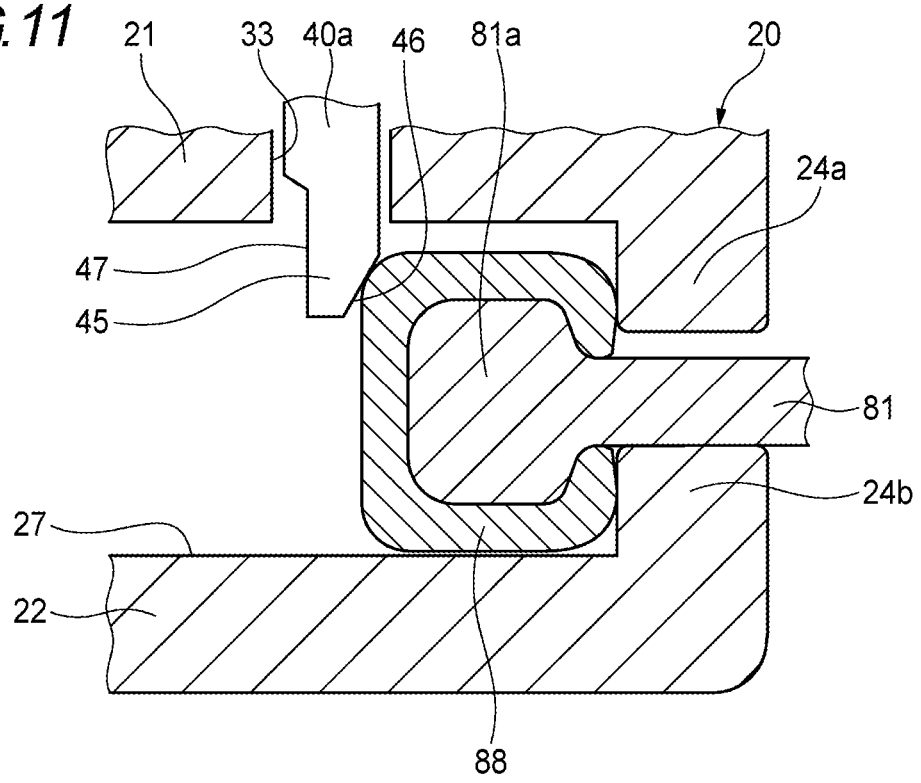
FIG. 11 is an enlarged cross-sectional view of a main part illustrating a state in which the insert pin comes in contact with an inclined surface of the claw portion.
Figure 12:
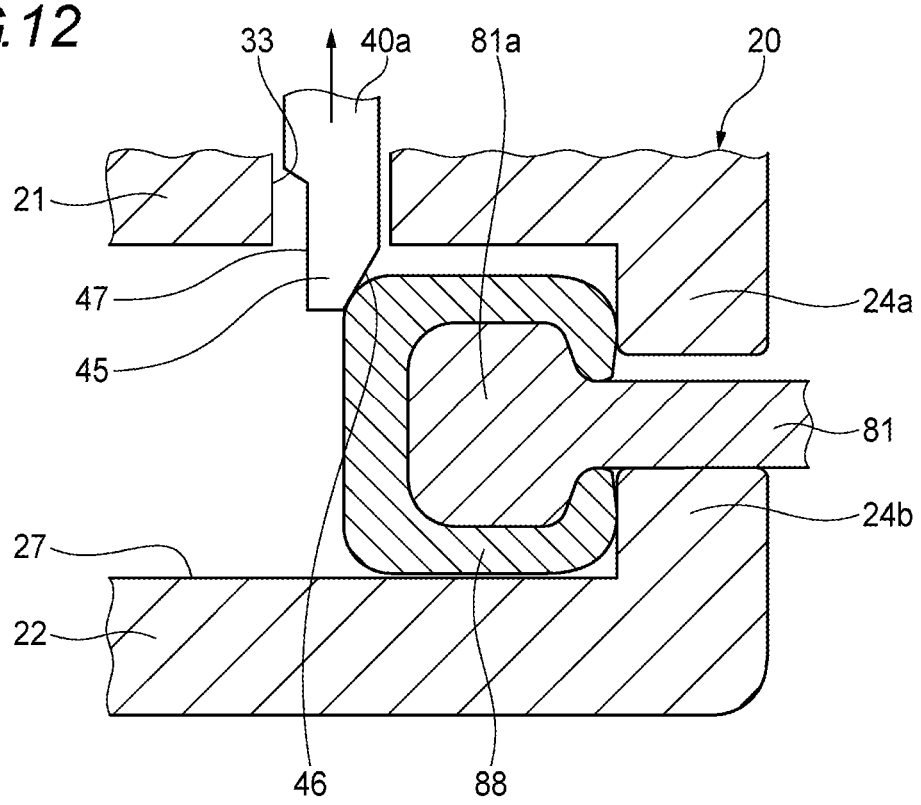
FIG. 12 is an enlarged cross-sectional view of a main part illustrating a state in which the claw portion is pushed up by the insert pin.

As shown in FIG. 3 to FIG. 5, an inclined surface 46 is formed on the right side surface of the claw portion 45 of the lock member 40. The inclined surface 46 is inclined so as to approach from the right side surface to the left side surface of the claw portion 45, and causes the claw portion 45 to be gradually tapered toward the front end of the claw portion 45. Due to this configuration, as shown in FIG. 10 to FIG. 12, when an insert pin 88 of an opening member (separable end stop) 85 of a slide fastener 80 is inserted into the slider 10, the insert pin 88 comes into contact with the inclined surface 46, so that the claw portion 45 is pushed up by the insert pin 88.

Figure 10:
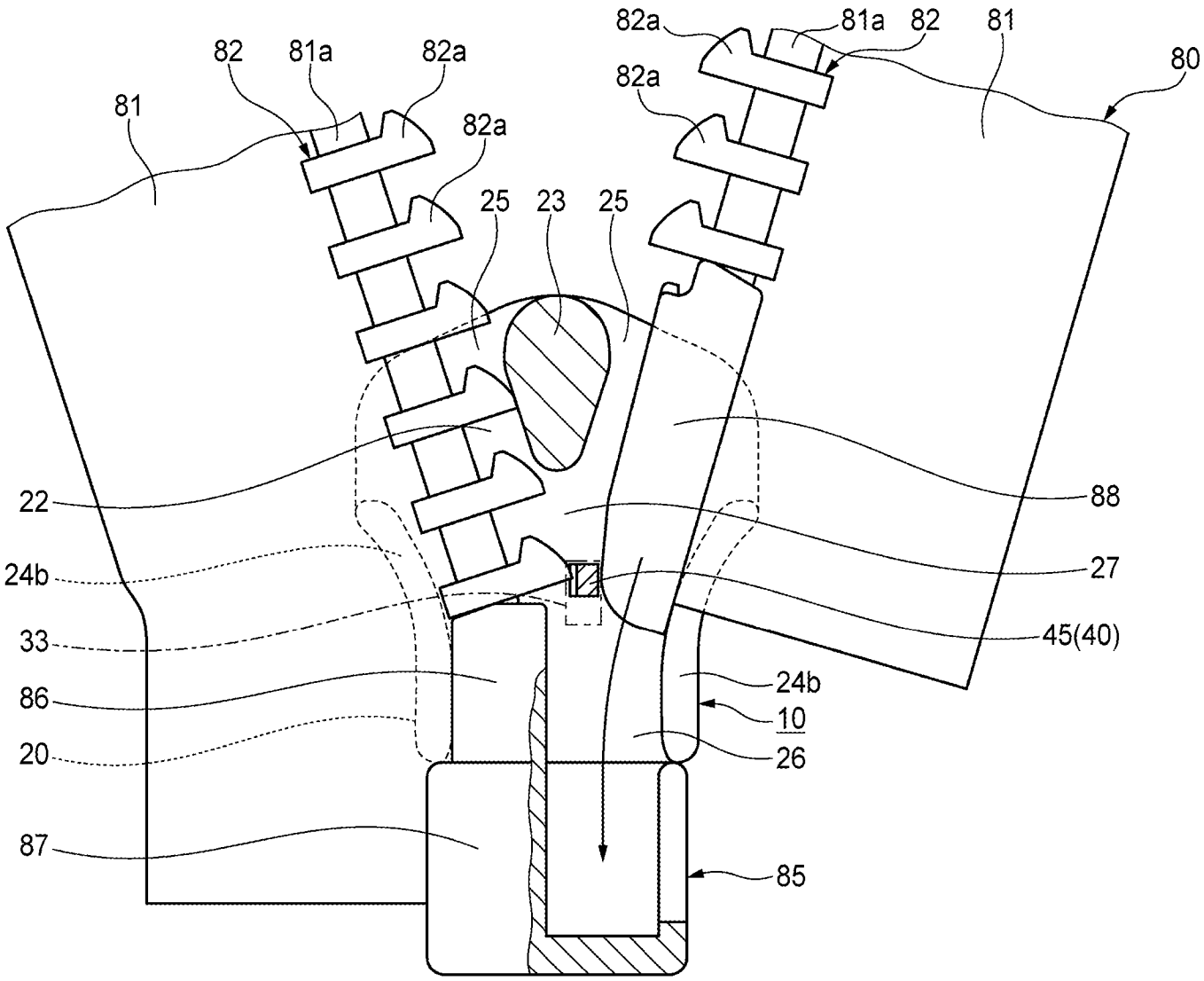
FIG. 10 is a partially-cutaway enlarged top-plan view of a slide fastener to which the slider for a slide fastener according to the present invention is attached, illustrating a state in which an insert pin of an opening member is inserted into the slider.

As shown in FIG. 10, the slide fastener 80 includes a pair of right and left fastener tapes 81, a pair of right and left fastener element rows 82 respectively provided on opposing tape side edge portions 81*a* of the pair of right and left fastener tapes 81, the pair of right and left fastener element rows 82 each having a plurality of fastener elements 82*a*, the slider 10 according to the present invention which is configured to engage and disengage the pair of right and left fastener element rows 82 with and from each other, and the opening member 85 which is formed at the lower end portions of the tape side edge portions 81*a* of the pair of right and left fastener tapes 81.

The opening member 85 includes a box pin 86 and a box body 87 which are formed at the lower end portion of the tape side edge portion 81*a* of the left fastener tape 81, and the insert pin 88 which is formed at the lower end portion of the tape side edge portion 81*a* of the right fastener tape 81. The insert pin 88 can be inserted into the box body 87. Although this embodiment employs the opening member 85 as the separable end stop, this is not intended to be limiting. A reverse opening member which includes a box pin and an insert pin may be employed in place of the opening member 85.

As shown in FIG. 3 to FIG. 5, a stepped portion 47 is formed on the left side surface of the claw portion 45 of the lock member 40. The stepped portion 47 is concave from the left side surface toward the right side surface of the claw portion 45, and causes the plate thickness W2 of the claw portion 45 to be smaller than the plate thickness W1 of the body portion 40*a*. Accordingly, as shown in FIG. 13, when the right and left fastener elements 82*a* engage with each other in response to sliding of the slider 10, the claw portion 45 is prevented from contacting the left fastener elements 82*a* (which are not engaged with the claw portion 45).

According to this embodiment, as shown in FIG. 5, in a protruding direction of the claw portion 45 (in the upward and downward direction), the formation area A1 of the stepped portion 47 is set to be greater than the formation area A2 of the inclined surface 46. Specifically, in the upward and downward direction of the lock member 40, the formation area A1 of the stepped portion 47 extends from the front end of the claw portion 45 to a position close to a base end of the claw portion 45 (a boundary portion between the lower piece portion 43 and the claw portion 45), whereas the formation area A2 of the inclined portion 46 is limited to a position close to the front end of the claw portion 45. The size of the formation area A1 is preferably 1.5 to 2.5 times the formation area A2.

As shown in FIG. 1 and FIG. 2, the cover member 50 has a top plate 51 which is bent so as to be convex upward, a pair of right and left side plates 52 extending downward from both side edges of the top plate 51, a front plate 53 extending downward from the front end portion of the top plate 51, and a rear plate 54 extending downward from the rear end portion of the top plate 51. A retracting portion 55 and a pull-tab accommodating portion 56 are provided at the lower end surfaces of the pair of right and left side plates 52 in the middle portion of the cover member 50. The retracting portion 55 and the pull-tab accommodating portion 56 are configured so as to be concave downward and face toward the body 20. A protrusion 57 extending downward is formed between the retracting portion 55 and the pull-tab accommodating portion 56.

In addition, fitting pieces 58 are respectively formed on the lower end portion of the pair of right and left side plates 52 at the front end side of the pair of right and left side plates 52. The fitting pieces 58 are fitted into fitting recesses 34 which are formed in the front end portion of the upper blade 21. In addition, when the fitting pieces 58 are fitted into the fitting recesses 34 and the pair of right and left side plates 52 are crimped into the recesses 31*c* which are formed in the outer side surfaces of the right and left wall portions 31*a*, 31*b* of the pillar portion 31, the cover member 50 is attached to the body 20 in a cantilever manner along the front-rear direction, with the front end portion thereof being fixed to the front end portion of the upper blade 21. In addition, the fitting recesses 34 are respectively formed at the right and left of the pillar portion 31, and extend in the front-rear direction of the body 20. The fitting pieces 58 protrude sideward from the lower ends of the pair of right and left side plates 52 of the cover member 50.

A rectangular leaf spring 70 which urges the claw portion 45 of the lock member 40 so as to enter the element guide path 72 is provided between the lock member 40 and the cover member 50. The front and rear end portions of the leaf spring 70 are respectively provided with engagement recess portions 71. When the front and rear engagement recess portions 71 are engaged with engagement convex portions 51*a* which are formed on the front and rear portions of the top plate 51 of the cover member 50, the leaf spring 70 is mounted inside the cover member 50. The engagement convex portions 51*a* are disposed inside the cover member 50 (i.e. inside the space surrounded by the top plate 51, the pair of right and left side plates 52, the front plate 53 and the rear plate 54).

The opening/closing member 60 has a first closing portion 61, second closing portion 62 and a valley portion 63, as shown in FIG. 1 and FIG. 2. The first closing portion 61 is formed into a substantially U-shape when viewed in a top plan view so as not to contact with the lock member 40 in a state in which the opening/closing member 60 is attached to the body 20, is formed on the rear end portion of the opening/closing member 60, and is formed into a substantially trapezoidal shape when viewed from the side. The second closing portion 62 is formed on the front end portion of the opening/closing member 60, and is formed into a substantially trapezoidal shape when viewed from the side. The valley portion 63 is provided between the first closing portion 61 and the second closing portion 62.

The lower end portions of both side surfaces of the opening/closing member 60 are respectively formed with guide portions 64 which are slidably fitted into guide recesses 35 which are formed along the front-rear direction in the upper surface of the upper blade 21 at the rear portion of the upper blade 21. Due to this configuration, the opening/closing member 60 is provided so as to be slidable in the front-rear direction with respect to the body 20. In addition, a coil spring 12 is provided in a compressed manner between the front end portion of the opening/closing member 60 and a spring-maintaining recess 35*a* which is formed inside the guide recess 35. The opening/closing member 60 is constantly urged toward the rear mouth 26 by an urging force of the coil spring 12.

A pair of right and left stoppers 36 is formed on the rear end portion of the upper surface of the upper blade 21. The stoppers 36 are configured to stop the opening/closing member 60 at a gap closing position where the insert gap S is closed and to prevent the opening/closing member 60 from being disengaged from the guide recess 35. When the opening/closing member 60 slides toward a gap opening position where the insert gap S is opened and the shaft portion 15*a* of the pull-tab 15 is inserted into the insert gap S, the shaft portion 15*a* is accommodated inside the operation recess portion 44 of the lock member 40.

Next, referring to FIG. 6 to FIG. 9, a description will be given below of the sequence of attaching the pull-tab 15 to the slider 10 for a slide fastener.

Figure 6:
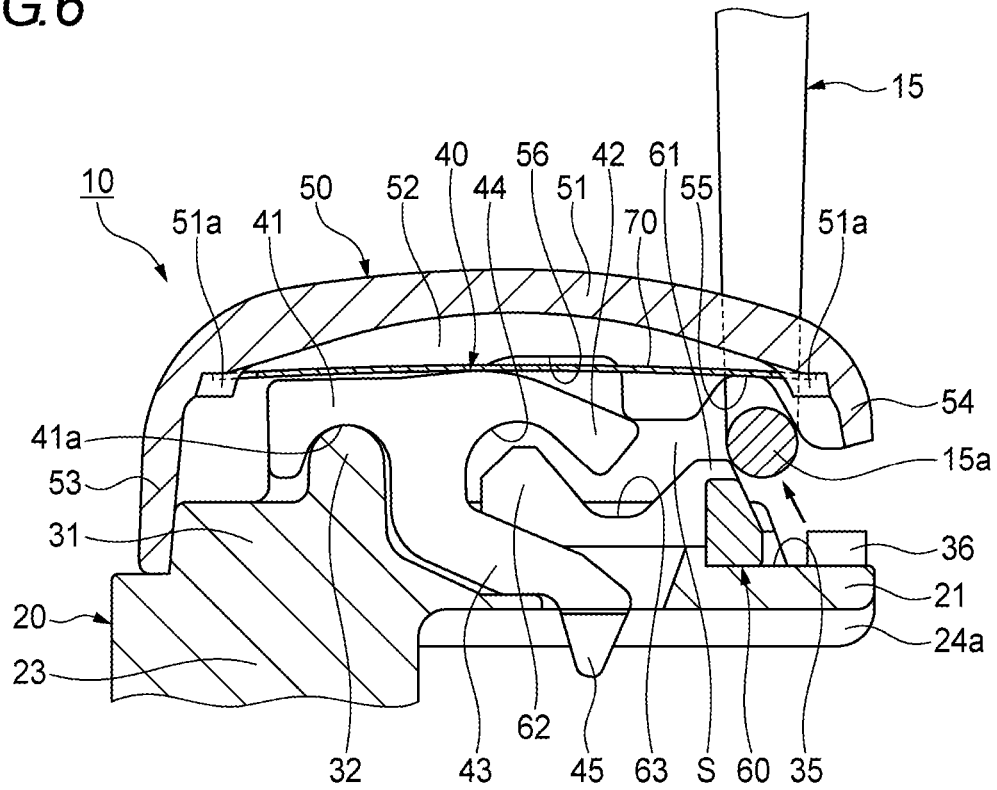
FIG. 6 is a vertical cross-sectional view of the slider illustrating a state in which a shaft portion of the pull-tab is pushed into an insert gap.
Figure 7:
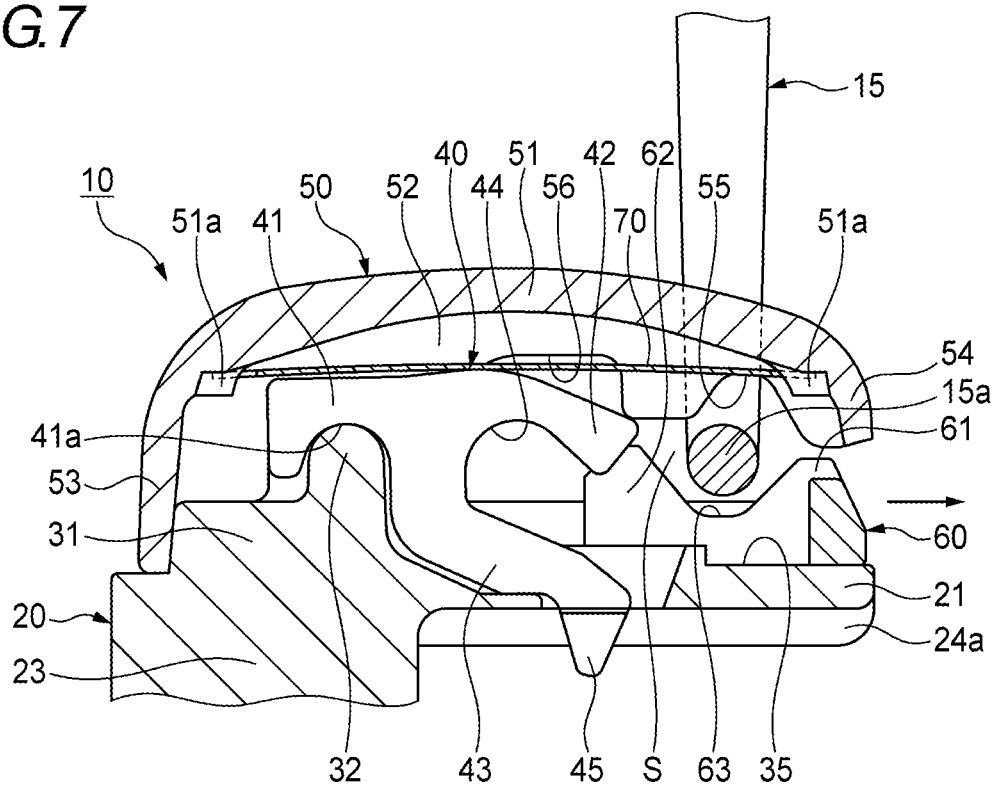
FIG. 7 is a vertical cross-sectional view of the slider illustrating a state in which the shaft portion of the pull-tab is inserted into a valley portion of an opening/closing member.

First, as shown in FIG. 6, when the shaft portion 15*a* of the pull-tab 15 is pushed into the insert gap S from rear to front, the opening/closing member 60 slides forward so that the shaft portion 15*a* of the pull-tab 15 is retracted into the retraction portion 55 of the cover member 50. Then, as shown in FIG. 7, the opening/closing member 60 slides rearward so that the shaft portion 15*a* of the pull-tab 15 enters the valley portion 63 between the first closing portion 61 and the second closing portions 62 of the opening/closing member 60.

Figure 8:
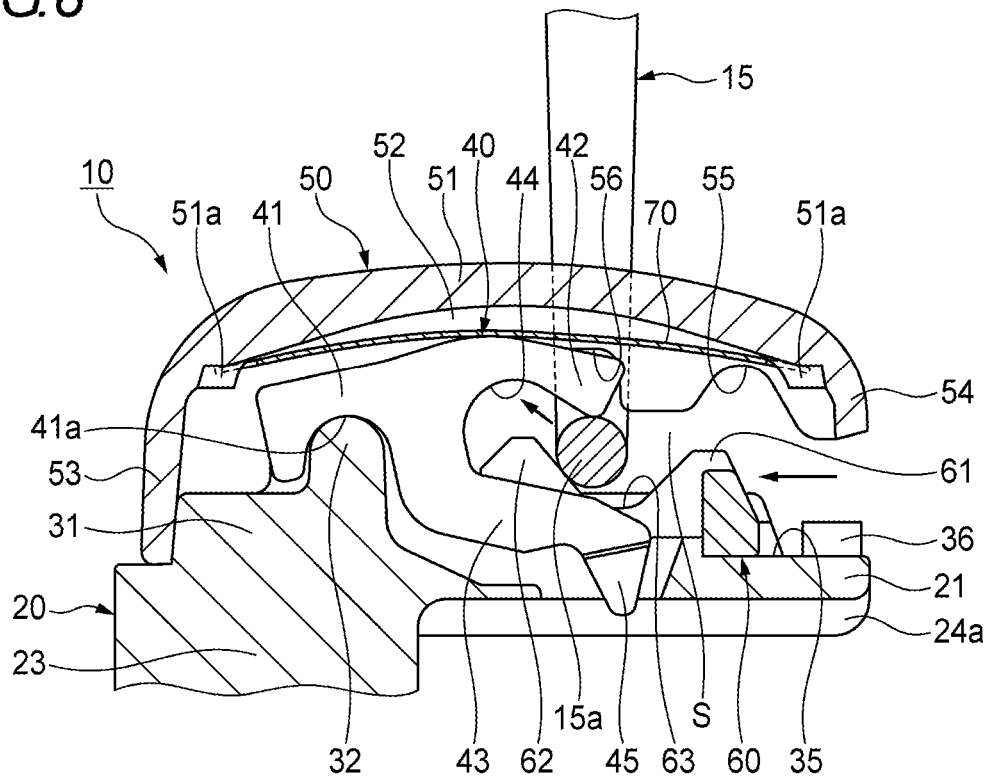
FIG. 8 is a vertical cross-sectional view of the slider illustrating a state in which the shaft portion of the pull-tab is further inserted into the insert gap.
Figure 9:
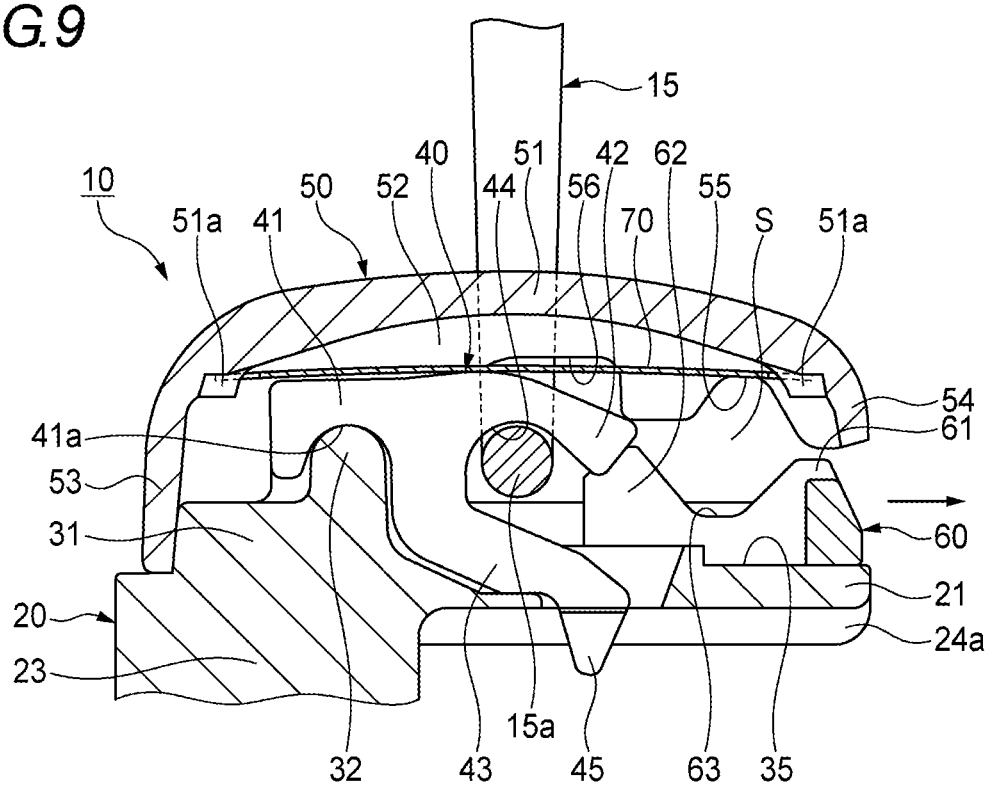
FIG. 9 is a vertical cross-sectional view of the slider illustrating a state in which the shaft portion of the pull-tab is accommodated in an operation recess portion of the lock member.

Afterwards, as shown in FIG. 8, when the shaft portion 15*a* of the pull-tab 15 is pushed further forward in the insert gap S, the opening/closing member 60 slides forward so that the shaft portion 15*a* of the pull-tab 15 enters the pull-tab accommodating portion 56 of the cover member 50 while pushing up the lock member 40. Then, as shown in FIG. 9, the opening/closing member 60 slides rearward so that the shaft portion 15*a* of the pull-tab 15 is accommodated inside the operation recess portion 44 of the lock member 40.

In the slider 10 for a slide fastener configured as above, when the insert pin 88 of the opening block 85 is inserted into the slider 10 as shown in FIG. 10, an angled portion of the insert pin 88 comes into contact with the inclined surface 46 of the claw portion 45 as shown in FIG. 11 and FIG. 12, so that the claw portion 45 is pushed up by the angled portion of the insert pin 88. Consequently, since the claw portion 45 is pushed up when the insert pin 88 is inserted into the slider 10, the operability for closing the opening member 85 is improved.

In addition, as shown in FIG. 13, in the finishing process of the slide fastener 80, when the pair of right and left fastener tapes 81 are moved and the slider 10 slides (in the finishing process, the slider 10 is fixed by a jig, and the fastener tape 81 side is moved by a transportation apparatus), the right and left fastener elements 82*a* are engaged with each other in the element guide path 27. At this time, the stepped portion 47 of the claw portion 45 prevents the claw portion 45 from coming into contact with the left fastener elements 82*a*. Accordingly, it becomes possible to move the pair of right and left fastener tapes 81 without pushing up the lock member 40, and thus it is not required to separately provide a lock-releasing device. In addition, as for the contact between the claw portion 45 and the right fastener elements 82*a*, the problem of obstructing the movement of the pair of right and left fastener tapes 81 does not occur, since the inclined surface in the front portion of the claw portion 45 allows the claw portion 45 to slide over the fastener elements 82*a* one after another in the direction in which the fastener elements 82*a* are engaged with each other.

As described above, according to the slider 10 for a slide fastener according to this embodiment, the inclined surface 46 which causes the claw portion 45 to be gradually tapered toward the front end of the claw portion 45 is formed on the right side surface of the claw portion. Due to this configuration, when inserting the insert pin 88 into the slider 10, the insert pin 88 comes into contact with the inclined surface 46, thereby pushing up the claw portion 45. This can consequently improve the operability for closing the opening member 85.

In addition, the stepped portion 47 is formed on the left side surface of the claw portion 45 of the lock member 40 such that the plate thickness W2 of the claw portion 45 is smaller than the plate thickness W1 of the body portion 40*a*. Due to this configuration, the claw portion 45 is prevented from contacting the left fastener elements 82*a*. Consequently, it is possible to engage the right and left fastener elements 82*a* with each other without providing the lock-releasing device, thereby reducing the manufacturing cost of the slide fastener 80.

Furthermore, according to the slider 10 for a slide fastener according to this embodiment, the claw portion 45 is formed with the inclined surface 46 and the stepped portion 47, and the claw portion 45 is taper-shaped. Consequently, when engaging the claw portion 45 and the fastener elements 82*a* with each other, it is possible to facilitate inserting the claw portion 45 into the narrow gap between the right and left fastener element rows 82*a* to be engaged with each other.

In addition, according to the slider 10 for a slide fastener according to this embodiment, even though the plate thickness W2 of the claw portion 45 is decreased due to the stepped portion 47, the strength of the body portion 40*a* can be maintained since the plate thickness W1 of the body portion 40*a* of the lock member 40 (the base portion 41, the upper piece portion 42 and the lower piece portion 43) stays thick.

Second Embodiment

Next, referring to FIG. 14 and FIG. 15, a description will be given below of a second embodiment of the slider for a slide fastener according to the present invention. The same reference numerals and signs will be used in the drawings in order to designate some components when they are the same as or like to those of the first embodiment, and descriptions of those components will be omitted or simplified.

Figure 14:
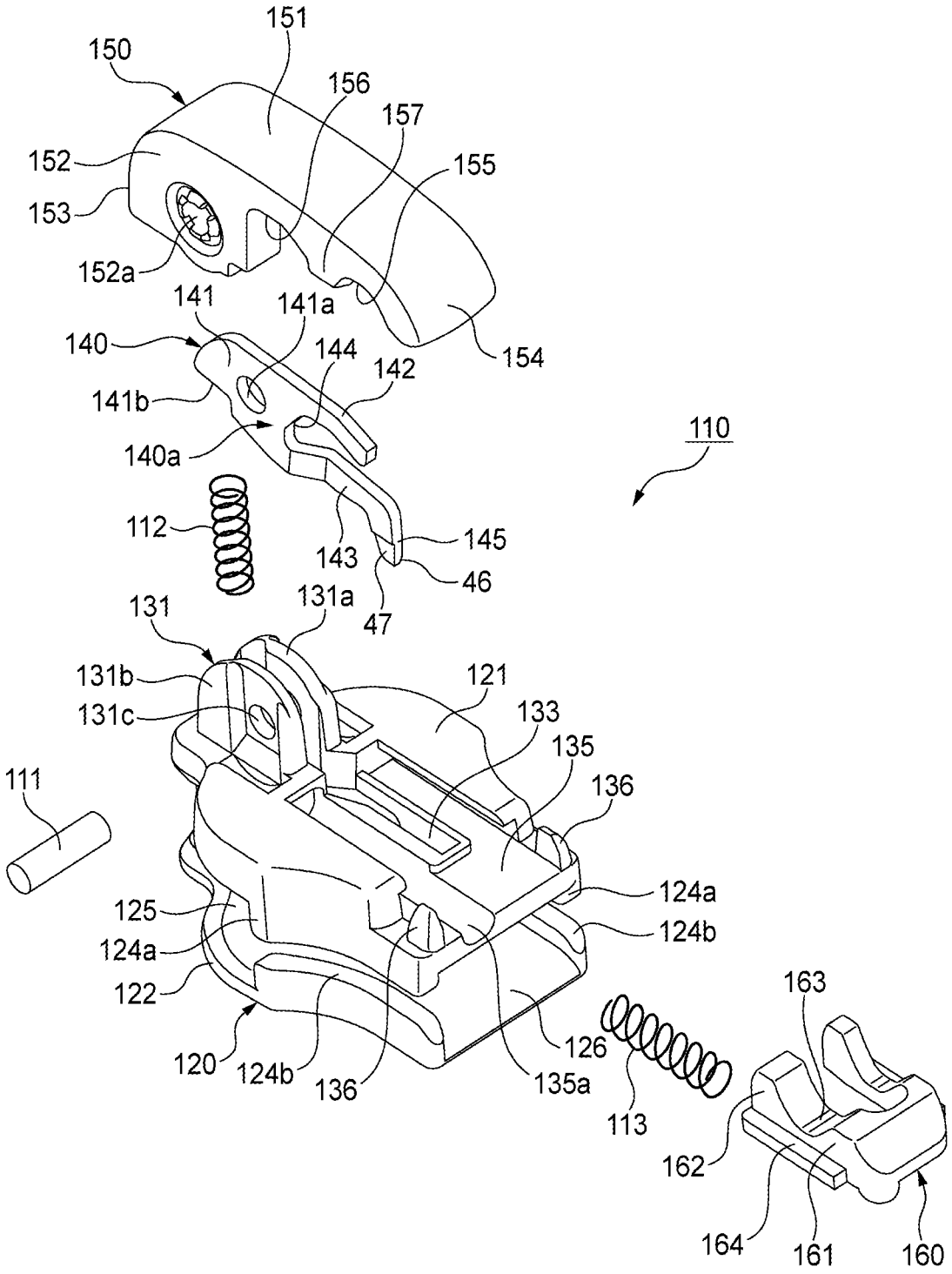
FIG. 14 is an exploded perspective view illustrating a second embodiment of the slider for a slide fastener according to the present invention.
Figure 15:
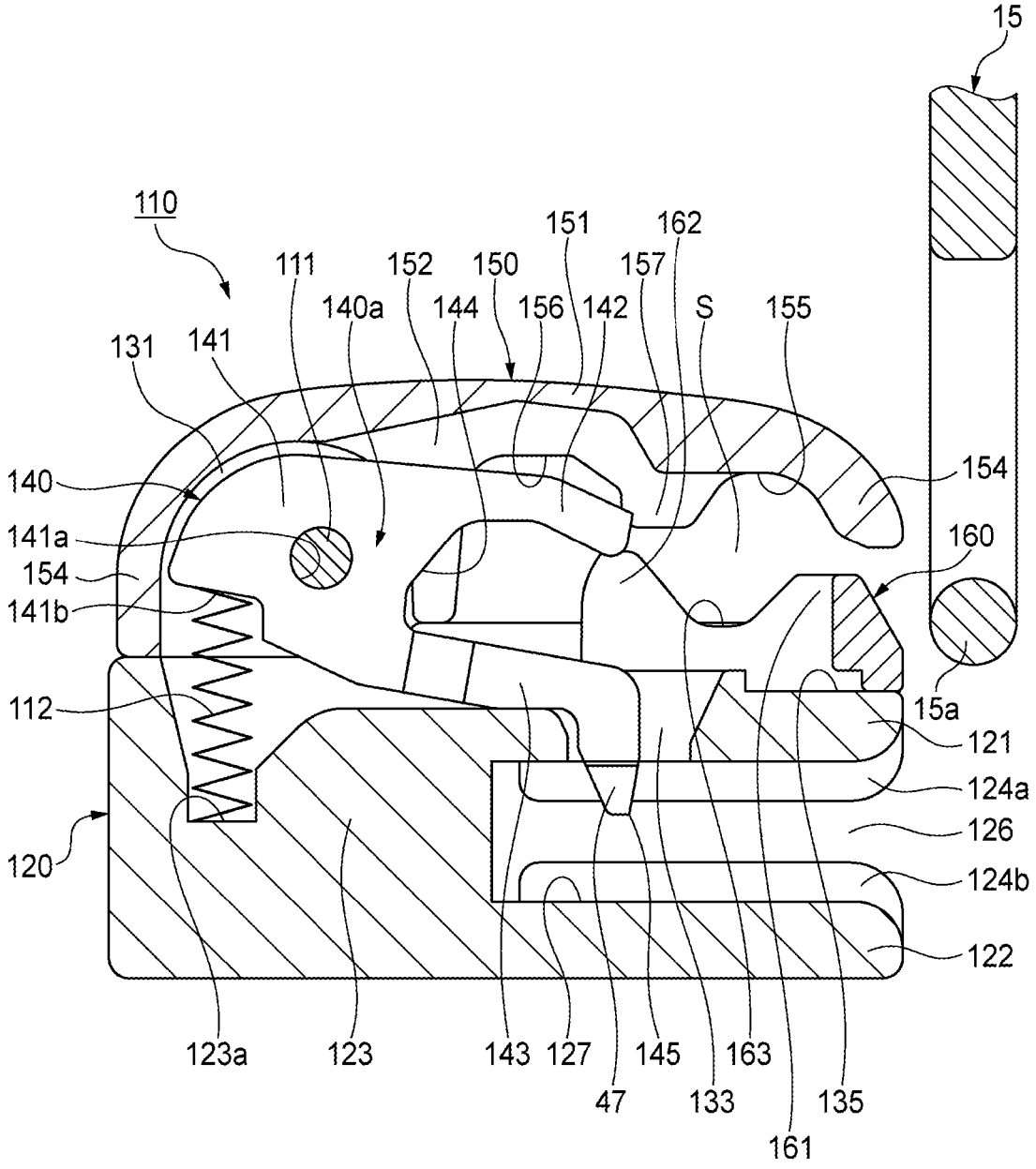
FIG. 15 is a vertical cross-sectional view of the slider for a slide fastener shown in FIG. 14 in a state in which a pull-tab is not mounted.

According to this embodiment, as well as the foregoing first embodiment, an inclined surface 46 is formed on the right side surface of a claw portion 145 of a lock member 140 of the slider 110 for a slide fastener and a stepped portion 47 is formed on the left side surface of the claw portion 145, as shown in FIG. 14 and FIG. 15.

The slider 110 for a slide fastener is a slider with an automatic stop function in which a pull-tab can be attached to and detached from a body. As shown in FIG. 14 and FIG. 15, the slider 110 has a body 120 which includes an upper blade 121 and a lower blade 122 which are spaced apart from each other in the upward and downward direction so as to be disposed in parallel to each other, a guide post 123 which connects the front end portion of the upper blade 121 to the front end portion of the lower blade 122, upper flanges 124*a* which protrude downward along right and left side edges of the upper blade 121, and lower flanges 124*b* which protrude upward along right and left side edges of the lower blade 122. Due to this configuration, right and left shoulder mouths 125 which are separated by the guide post 123 are formed in the front portion of the body 120, and a rear mouth 126 is formed in the rear portion of the body 120. In addition, an element guide path 127 which is formed into a substantially Y-shape is formed between the upper blade 121 and the lower blade 122 to communicate the right and left shoulder mouths 125 with the rear mouth 126. The element guide path 127 constitutes a path into which a pair of right and left fastener element rows 82 is inserted.

In addition, the slider 110 for a slide fastener 130 includes a lock member 140, a cover member 150, a pin 111 and an opening/closing member 160. The lock member 140 is supported by a pillar portion 131 so as to be swingable up and down, the pillar portion 131 being erected on the front end portion of the upper surface of the upper blade 121. The cover member 150 covers the pillar portion 131 and the lock member 140 from above. The pin 111 penetrates through the pillar portion 131, the lock member 140 and the cover member 150, and acts as the center of rotation of the lock member 140. The opening/closing member 160 is formed between the rear end portion of the cover member 150 and the upper blade 121, and is configured to open/close an insert gap S into which a shaft portion 15*a* of the pull-tab 15 is inserted.

The pillar portion 131 has right and left wall portions 131*a* and 131*b* which are spaced apart from each other at a gap into which the lock member 140 can be fitted. The right and left wall portions 131*a* and 131*b* are respectively formed with pin insert holes 131*c* into which the pin 111 is inserted.

As shown in FIG. 14 and FIG. 15, the lock member 140 has a body portion 140*a* which is disposed on the upper surface of the upper blade 121. The body portion 140*a* has a base portion 141 which has a pin insert hole 141*a* into which the pin 111 is inserted, and an upper piece portion 142 and a lower piece portion 143 which respectively extend rearward from the base portion 141 and are disposed so as to face each other in the upward and downward direction. In addition, an operation recess portion 144 is formed between the upper piece portion 142 and the lower piece portion 143. The operation recess portion 144 is opened toward the rear mouth 126 to accommodate the shaft portion 15*a* of the pull-tab 15 in an attachment state. In addition, a claw portion 145 which is directed downward is provided at the front end portion of the lower piece portion 143. The claw portion 145 is configured to enter the element guide path 127 through a claw hole 133 formed in the upper blade 121. The claw hole 133 penetrates from the upper surface of the upper blade 121 through the element guide path 127.

As shown in FIG. 14 and FIG. 15, the cover member 150 has a top plate 151 which is bent so as to be convex upward, a pair of right and left side plates 152 extending downward from both side edges of the top plate 151, a front plate 153 extending downward from the front end portion of the top plate 151, and a rear plate 154 extending downward from the rear end portion of the top plate 151. A retracting portion 155 and a pull-tab accommodating portion 156 are provided at the lower end surfaces of the rear portion of the pair of right and left side plates 152. The retracting portion 155 and the pull-tab accommodating portion 156 are configured so as to be concave downward and face toward the body 120. A protrusion 157 extending downward is formed between the retracting portion 155 and the pull-tab accommodating portion 156.

In addition, the lock member 140 is inserted between the right and left wall portions 131*a*, 131*b* of the pillar portion 131 and the pin 111 is inserted into the pin insert hole 141*a* of the lock member 140 and the pin insert holes 131*c* of the left and right wall portions 131*a*, 131*b*. Consequently, the lock member 140 is pivotably supported so as to be swingable up and down with respect to the body 120. The pin 111 is inserted into through-holes 152*a* which are respectively formed in the pair of right and left side plates 152 of the cover member 150, and the cover member 150 is fixed to the pillar portion 131 through the pin 111.

As shown in FIG. 15, the lock member 140 is urged by a first coil spring 112 which is embedded inside the slider 110 so that the claw portion 145 of the lock member 140 enters the element guide path 127. Specifically, the first coil spring 112 is provided while being compressed, between a spring bearing surface 141*b* formed on the lower surface of the base portion 141 of the lock member 140 and a spring-holding hole 123*a* which is formed in the guide post 123. The lock member 140 is constantly urged such that the lock member 140 swings about the pin 111 when the spring bearing surface 141*b* receives the urging force of the first coil spring 112 and such that the claw portion 145 protrudes into the element guide path 127 through the claw hole 133. The spring bearing surface 141*b* is formed on a concave surface of the lock member 140, that is upwardly concaved in a stepped manner, in the front and lower portion of the pin insert hole 141*a* of the base portion of the lock member 140. The spring-holding hole 123*a* extends along the upward and downward direction of the slider 110, and has a bottom surface on which the first spring 112 is to be placed.

The opening/closing member 160 has a first closing portion 161, second closing portion 162 and a valley portion 163, as shown in FIG. 14 and FIG. 15. The first closing portion 161 is formed into a substantially U-shape when viewed in a top plan view so as not to contact with the lock member 140 in a state in which the opening/closing member 160 is attached to the body 120, is formed on the rear end portion of the opening/closing member 160, and is formed into a substantially trapezoidal shape when viewed from the side. The second closing portion 162 is formed on the front end portion of the opening/closing member 160, and is formed into a substantially trapezoidal shape when viewed from the side. The valley portion 163 is provided between the first closing portion 161 and the second closing portion 162.

The lower end portions of both side surfaces of the opening/closing member 160 are respectively formed with guide portions 164 which are slidably fitted into a guide recess 135 which is formed along the front-rear direction in the upper surface of the rear portion of the upper blade 121. Due to this configuration, the opening/closing member 160 is provided so as to be slidable in the front-rear direction with respect to the body 120. A second coil spring 113 is provided while being compressed, between the front end portion of the opening/closing member 160 and a spring-maintaining recess 135*a* which is formed inside the guide recess 35. The opening/closing member 160 is constantly urged toward the rear mouth 126 by the urging force of the second coil spring 112.

The rear end portion of the upper surface of the upper blade 121 is formed with a pair of right and left stoppers 136 which are configured to stop the opening/closing member 160 at a gap closing position where the insert gap S is closed while preventing the opening/closing member 160 from being disengaged from the guide recess 135. When the opening/closing member 160 slides toward a gap opening position where the insert gap S is opened and the shaft portion 15*a* of the pull-tab 15 is inserted into the insert gap S, the shaft portion 15*a* is accommodated inside the operation recess portion 144 of the lock member 140.

The other configurations and the advantageous effects are the same as those of the first embodiment.

The present invention is not limited to those that were illustrated in the foregoing embodiments but can be suitably changed without departing from the concept of the present invention.

Figure 16:
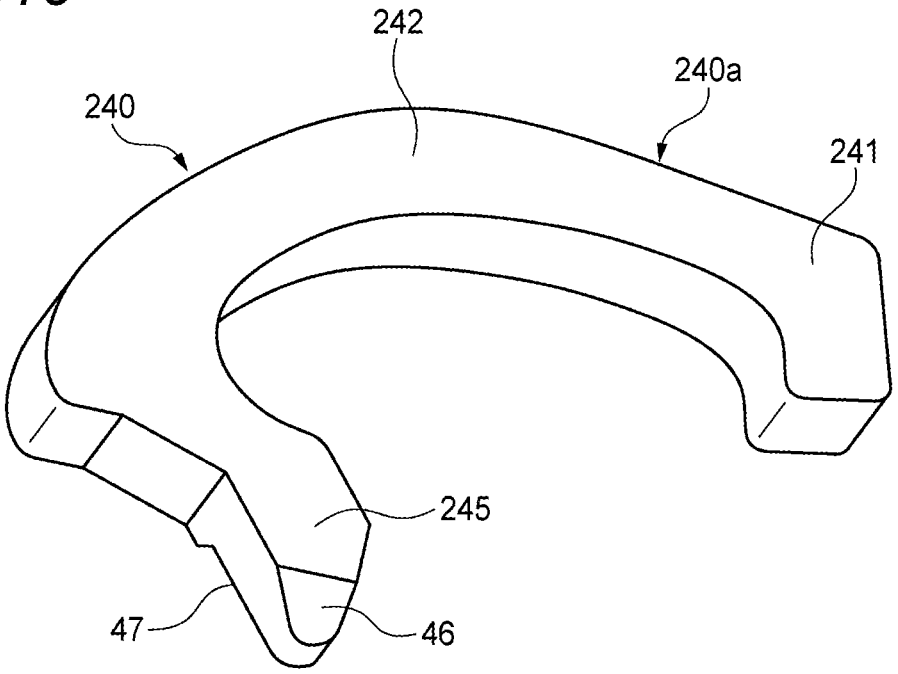
FIG. 16 is a perspective view of a lock member of the slider with an automatic stop function in which a pull-tab cannot be attached to or detached from a body.

Although the foregoing embodiments of the present invention were illustrated being applied to a slider with an automatic stop function in which the pull-tab can be attached to and detached from the body, the present invention is not limited thereto. The present invention may be applied to a slider with an automatic stop function in which the pull-tab cannot be attached to and detached from the body. Such a type of slider is provided with a lock member 240 shown in FIG. 16. The lock member 240 includes a body portion 240*a* which has a base portion 241 and a single arm portion 242 extending rearward from the base portion 241, and a claw portion 245 which protrudes downward from the leading end portion of the arm portion 242. An inclined surface 46 is formed on the right side surface of the claw portion 245, and a stepped portion 47 is formed on the left side surface of the claw portion 245.

DESCRIPTION OF REFERENCE NUMERALS

10, 110 Slider for Slide Fastener
20, 120 Body
27, 127 Element Guide Path
31, 131 Pillar Portion
40, 140 Lock Member
40 *a*, 140*a* Body Portion
45, 145 Claw Portion
46 Inclined Surface
47 Stepped Portion
50, 150 Cover Member
80 Slide Fastener
82 Fastener Element Row
82*a* Fastener Element
85 Opening Member (Separable End Stop)
88 Insert Pin
A1 Formation Area of Stepped Portion
A2 Formation Area of Inclined Surface
W1 Plate Thickness of Body Portion
W2 Plate Thickness of Claw Portion

The invention claimed is:

1. A slide fastener comprising:
a pair of fastener tapes;
a pair of fastener element rows respectively provided on opposing tape side edge portions of the pair of fastener tapes, the pair of fastener element rows each having a plurality of fastener elements;
a slider configured to engage and disengage the pair of fastener element rows with and from each other; and
a separable end stop including;
a box pin formed at one end portion of one of the tape side edge portions of one of the fastener tapes; and
an insert pin formed at one end portion of another of the tape side edge portions of another of the fastener tapes and which is configured to be inserted into an element guide path of the slider,
wherein the slider includes:
a body forming the element guide path;
a lock member which is swingably supported by a pillar portion which is erected on an upper surface of the body; and
a cover member which covers the pillar portion and the lock member from above,
wherein the lock member comprises a body portion which is disposed on the upper surface of the body and a claw portion which protrudes from the body portion and is configured to enter the element guide path of the body,
wherein the lock member has a plate shape comprising a first main surface and a second main surface opposite the first main surface and a thickness direction of the plate shape of the lock member is defined as a direction perpendicular to the first main surface and the second main surface,
wherein the lock member is attached to the body such that the thickness direction is oriented to a width direction of the slider,
wherein one side surface of the claw portion in the thickness direction is formed with an inclined surface which causes a plate thickness of the claw portion to be gradually tapered toward a tip end of the claw portion, and the insert pin of the separable end stop is configured to come into contact with the inclined surface of the claw portion and push up the claw portion when the insert pin is inserted into the element guide path, and
wherein another side surface of the claw portion in the thickness direction is formed with a stepped portion which causes the plate thickness of the claw portion to be smaller than the plate thickness of the body portion.

2. The slide fastener according to claim 1, wherein a formation area of the stepped portion is greater than a formation area of the inclined surface in a protruding direction of the claw portion.

3. A slide fastener comprising:
a pair of fastener tapes;
a pair of fastener element rows respectively provided on opposing tape side edge portions of the pair of fastener tapes, the pair of fastener element rows each having a plurality of fastener elements;
a slider configured to engage and disengage the pair of fastener element rows with and from each other; and
a separable end stop including;
a box pin formed at one end portion of one of the tape side edge portions of one of the fastener tapes; and
an insert pin formed at one end portion of another of the tape side edge portions of another of the fastener tapes and which is configured to be inserted into an element guide path of the slider,
wherein the slider includes:
a body forming the element guide path;
a lock member which is swingably supported by a pillar portion which is erected on an upper surface of the body; and
a cover member which covers the pillar portion and the lock member from above,
wherein the lock member comprises a claw portion which is configured to enter the element guide path of the body,
wherein the lock member has a plate shape comprising a first main surface and a second main surface opposite the first main surface and a thickness direction of the plate shape of the lock member is defined as a direction perpendicular to the first main surface and the second main surface,
wherein the lock member is attached to the body such that the thickness direction is oriented to a width direction of the slider, and
wherein one side surface of the claw portion in the thickness direction is formed with an inclined surface, and the insert pin of the separable end stop is configured to come into contact with the inclined surface of the claw portion and push up the claw portion when the insert pin is inserted into the element guide path.

4. The slide fastener according to claim 1, wherein the plate thickness is substantially uniform in the body portion of the lock member.

* * * * *